US008629360B2

(12) United States Patent
Pillans et al.

(10) Patent No.: US 8,629,360 B2
(45) Date of Patent: Jan. 14, 2014

(54) RF MICRO-ELECTRO-MECHANICAL SYSTEM (MEMS) CAPACITIVE SWITCH

(75) Inventors: Brandon William Pillans, Plano, TX (US); Cody Blake Moody, Frisco, TX (US); Francis Joseph Morris, Dallas, TX (US)

(73) Assignee: Raytheon Company, Waltham, MA (US)

( * ) Notice: Subject to any disclaimer, the term of this patent is extended or adjusted under 35 U.S.C. 154(b) by 86 days.

(21) Appl. No.: 13/460,056

(22) Filed: Apr. 30, 2012

(65) Prior Publication Data

US 2013/0284571 A1 Oct. 31, 2013

(51) Int. Cl.
*H01H 57/00* (2006.01)

(52) U.S. Cl.
USPC ..... 200/181

(58) Field of Classification Search
USPC ..... 200/181, 513, 600, 267, 257, 512, 269; 335/78
See application file for complete search history.

(56) References Cited

U.S. PATENT DOCUMENTS

| | | | | |
|---|---|---|---|---|
| 6,100,477 | A * | 8/2000 | Randall et al. | 200/181 |
| 6,452,124 | B1 * | 9/2002 | York et al. | 200/181 |
| 6,608,268 | B1 | 8/2003 | Goldsmith | |
| 6,791,441 | B2 | 9/2004 | Pillans et al. | |
| 6,803,534 | B1 * | 10/2004 | Chen et al. | 200/181 |
| 7,002,441 | B2 | 2/2006 | Pillans et al. | |
| 2002/0179421 | A1 | 12/2002 | Williams et al. | |
| 2003/0006777 | A1 | 1/2003 | Murphy | |

FOREIGN PATENT DOCUMENTS

WO 03/054938 A1 7/2003

* cited by examiner

*Primary Examiner* — Edwin A. Leon
(74) *Attorney, Agent, or Firm* — Eric A. Gifford

(57) ABSTRACT

An RF MEMS capacitive switch aligns holes in one of its electrodes to dielectric posts to reduce trapped charge without affecting the capacitance ratio of the switch. When actuated, the electrode contacts the posts' one or more contact surfaces around the plurality of holes so that each hole overlaps at least a central portion of the post to which it is aligned. By selecting the hole size such that the top electrode appears to be approximately a continuous conductive sheet at the RF frequency, the alignment of the holes to the posts reduces the amount of trapped charge without lowering switch capacitance. In different embodiments, the post diameter may be smaller than the hole diameter so that the overlap is complete, in which case trapped charge is largely eliminated.

20 Claims, 8 Drawing Sheets

10
16
12
14

+
Vp
-
16
12
22
14

20

18
12

RF MICRO-ELECTRO-MECHANICAL SYSTEM (MEMS) CAPACITIVE SWITCH

BACKGROUND OF THE INVENTION

1. Field of the Invention

This invention relates to RF micro-electro-mechanical system (MEMS) capacitive switches and, more particularly, to the reduction of trapped charge in RF MEMS capacitive switches.

2. Description of the Related Art

A radio frequency (RF) micro-electro-mechanical system (MEMS) capacitive switch includes a top electrode that is displaced toward a bottom electrode in response to the application of a voltage differential between the electrodes. An RF signal applied to one of the electrodes sees a variable capacitance based on the displacement. In various types of MEMS capacitive switches the top electrode may include a flexible membrane that is suspended between two or more posts and displaced parallel to the bottom electrode, a rigid beam that is cantilevered from a single post or a flexible vertical beam that is incrementally displaced to a horizontal position akin to a "zipper". The top electrode exhibits a resilience that resists the displacement and urges the top electrode to return to a deactuated position, which it does when the voltage differential is removed. Different types of MEMS switches may be "binary" such as the membrane or cantilevered switches or "analog" such as the zipper switch.

To both maximize the capacitance in the actuated state and to prevent the top electrode from contacting the bottom electrode, the MEMS capacitive switch includes dielectric material formed on the bottom electrode. One problem is that, when the top electrode is displaced and contacting the dielectric material in the actuated state of the switch, electric charge can tunnel into and become trapped in the dielectric material. As a result, and due to long recombination times in the dielectric, the amount of this trapped charge in the dielectric material increases progressively over time and exerts a progressively increasing attractive force on the top electrode. When the top electrode is in its actuated position, this attractive force tends to resist movement of the top electrode away from its actuated position toward its deactuated position. The amount of trapped charge can eventually increase to the point where the attractive force exerted on the top electrode by the trapped charge is in excess of the inherent resilient force of the top electrode, which is urging the top electrode to return to its deactuated position. As a result, the top electrode becomes trapped in its actuated position, and the switch is no longer capable of carrying out a switching function. This is considered a failure of the switch, and is associated with an undesirably short operational lifetime for the switch.

Many prior attempts have been made to solve or at least reduce the dielectric charging problem. One approach was to change the properties of the dielectric material so as to modify the extent to which the dielectric material is "leaky". Another prior approach is to alter the waveform used for the DC bias voltage. Another prior approach is to "texture" one or both of the top electrode or dielectric material. Yet another prior approach is to pattern the dielectric material to form an array of posts. This approach reduces the amount of trapped charge but also reduces the amount of dielectric material between the electrodes, which runs counter to the traditional design goal to maximize the capacitance ratio of the switch.

Referring now to FIGS. 1*a*-1*d*, an embodiment of an RF MEMS capacitive switch 10 of a "membrane" type is shown in which the dielectric material has been patterned to form an array of dielectric posts 12 that separate a bottom electrode 14 from a suspended top electrode 16. In this embodiment, the membrane itself is formed of a conductive material such as aluminum that forms top electrode 16. An RF signal is applied to one of the bottom electrode and the membrane. A number of vent holes 18 are etched in the membrane to facilitate removal of sacrificial layers used during fabrication and to reduce squeeze-film damping when the membrane is displaced. The vent holes 18 in the membrane are placed away from the underlying posts 12 to ensure complete metal/dielectric coverage 20 in the actuated state to maximize the capacitance. As shown, when top electrode 16 is contacting the dielectric post 12 in the actuated state, electric charge 22 can tunnel into and become trapped in the post. The problem of trapped charge remains but is reduced proportional to the sparsity or fill-factor of the posts as compared to a solid dielectric layer.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides a topology for an RF MEMS capacitive switch that reduces the dielectric charging problem.

In an embodiment, a top electrode is displaced toward a bottom electrode in response to the application of a voltage differential between the electrodes. The top electrode may, for example, be supported as a "membrane" or "cantilever" to provide resilience to urge the top electrode to return to its deactuated position. An RF signal is coupled to one of the top or bottom electrode. A patterned dielectric material provides a plurality of posts that support one or more contact surfaces that prevent the top electrode from contacting the bottom electrode when displaced. In different embodiments, the contact surfaces are the top surface of a cylindrical post, the side surfaces of a conically-shaped post, contact pads supported by undercut posts or a dielectric layer supported by the multiple posts. A plurality of holes in the second electrode is aligned to the plurality of posts, respectively. When displaced, the top electrode contacts the one or more contact surfaces around the plurality of holes so that each hole overlaps at least a central portion of the post to which the hole is aligned. By selecting the hole size such that the top electrode appears to be approximately a continuous conductive sheet at the frequency of the RF signal, the alignment of the holes to the posts reduces the amount of trapped charged without lowering the capacitance. In different embodiments, the post diameter may be smaller than the hole diameter so that the overlap is complete, in which case trapped charge is largely eliminated. In different embodiments, the top electrode may only contact the insulating structure in annular rings around each hole to reduce the contact area, thus reducing environmental stiction problems.

These and other features and advantages of the invention will be apparent to those skilled in the art from the following detailed description of preferred embodiments, taken together with the accompanying drawings, in which:

DETAILED DESCRIPTION OF THE INVENTION

The present invention describes a topology for an RF MEMS capacitive switch that reduces the dielectric charging problem without affecting the capacitance ratio of the switch.

In the design of MEMS capacitive switches, a traditional design goal is to try to maximize the capacitance ratio of the switch, which is the ratio of the capacitance between the top and bottom electrodes in the actuated state to the corresponding capacitance in the deactuated state. In an effort to maximize the capacitance in the actuated state, pre-existing MEMS switch designs attempt to position the top electrode as close as possible to the conductive part in the actuated state of the switch, which in turn means that the dielectric material separating them needs to be relatively thin e.g. a few hundred Angstroms thick. Additionally, the pre-existing MEMS switch designs attempt to maximize the amount of dielectric material separating the electrodes, which in the case of "posts" has meant spacing the posts away from the vent holes.

Figures 1A, 1B, 1C, 1D:
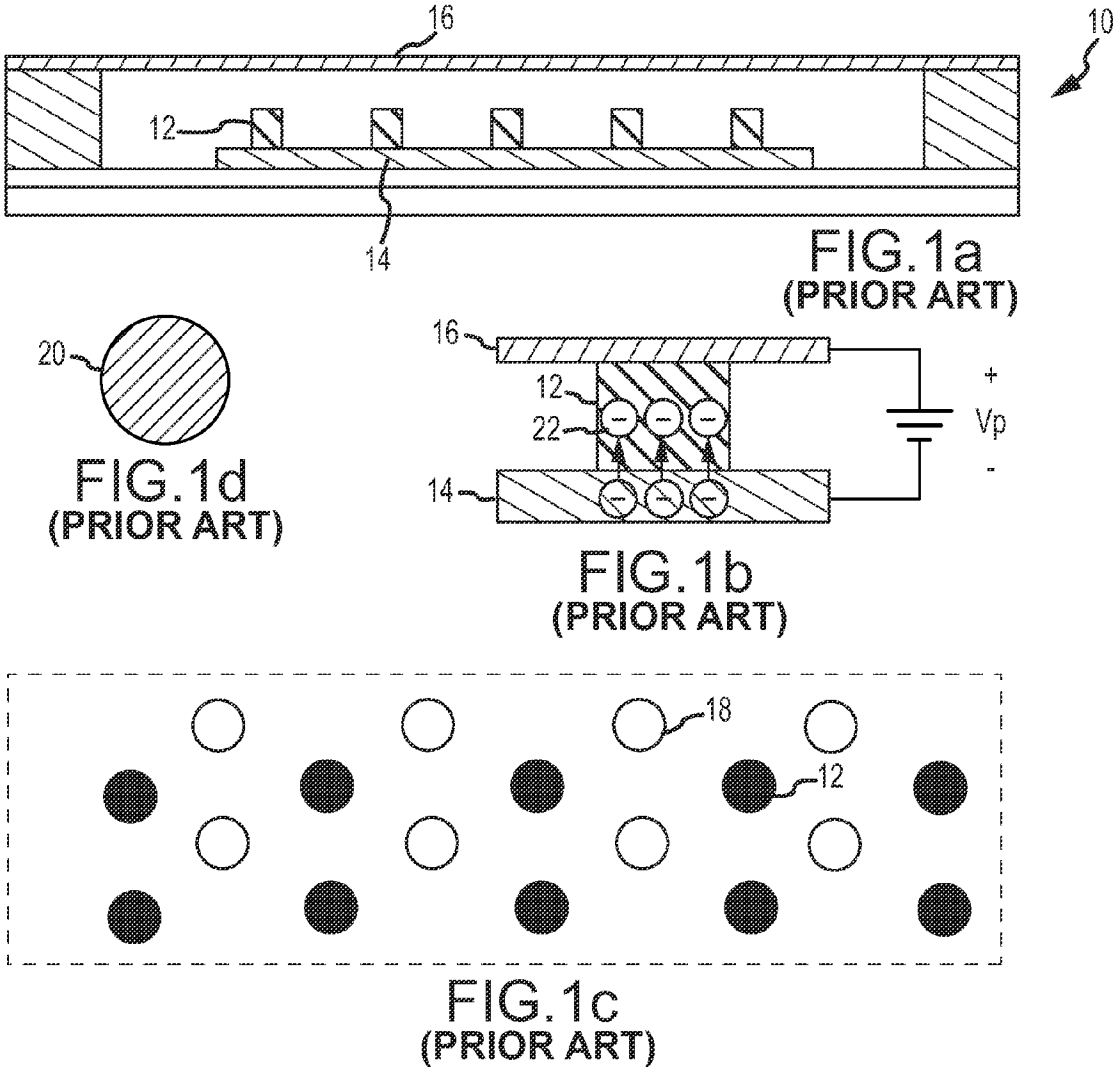
FIG. 1a (PRIOR ART)
FIG. 1b (PRIOR ART)
FIG. 1d (PRIOR ART)
FIG. 1c (PRIOR ART)
FIGS. 1*a*-1*d*, as described above, are different views of an existing RF MEMS capacitive switch in which insulating posts are positioned orthogonal to the vent holes to maintain the capacitance ratio of the switch while preventing the flexible top electrode from contacting the bottom electrode.
Figure 2A:
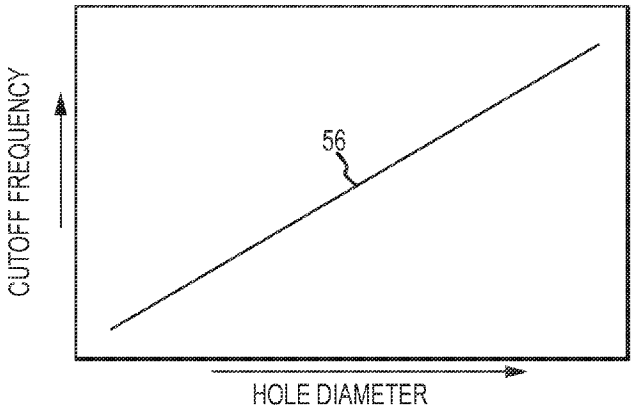
FIG. 2*a* is a plot of the relationship between the cutoff frequency at which the RF signal sees a continuous conductive sheet and below it sees a reduced capacitive area and FIGS. 2*b* and 2*c* are diagrams of the field lines of an RF signal in a conductive sheet with holes at frequencies above and below the cutoff frequency, respectively.
Figure 2B:
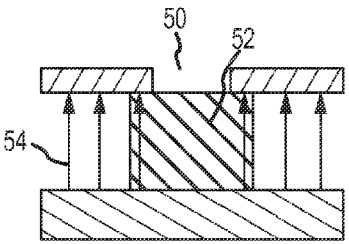
Figure 2C:
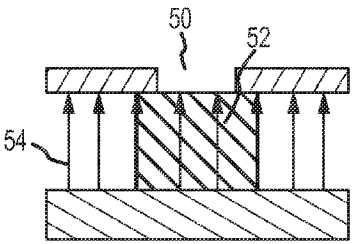

Referring now to FIGS. 2*a*-2*c*, recent simulations verified by experimentation have shown us that the perceived loss of capacitance by aligning and overlapping electrode holes 50 with the dielectric posts 52 is very minimal at RF/microwave frequencies with proper hole sizing. As illustrated RF/microwave fields 54 tend to jump across small gaps in metal such as the holes in the top electrode at frequencies above a cut-off frequency 56 (FIG. 2*b*). At frequencies below cut-off frequency 56, the fields 54 do not jump across the holes (FIG. 2*c*). Consequently, the holes in the electrode may be properly sized and aligned to the dielectric posts without causing a reduction in the on-capacitance of the switch. By scaling the membrane hole size to the intended frequency of operation, the capacitance impact of aligning the holes with the posts can be minimized. The relationship between the useful frequency of operation with the aligned hole size is such that the smaller the membrane hole, the lower the device cut-off frequency 56 that the device can operate without a reduction in switch capacitance due to the membrane hole. There will be a graceful reduction in capacitance as the operating frequency is lowered past the cut-off frequency 56 until at DC the full effect of the hole is realized. Higher frequencies above cut-off show no effect due to the hole.

Alignment of the holes to the underlying posts produces an overlap of each hole to at least a central portion of the post to which it is aligned. Ignoring minor DC fringing fields, there are no DC electric field lines between the top and bottom electrodes within the overlap. This reduces DC or low frequency charge transport into the dielectric, hence reduces trapped charge. Note that RF frequencies do not charge the dielectric due to the time constants required for charging. In some embodiments, the posts may be under cut so that the hole overlaps the entire post. Again ignoring minor DC fringing fields, this structure should completely cut-off DC charge transport into the dielectric, eliminating trapped charge altogether. In different embodiments, the hole/post alignment also reduces the contact area, thus reducing environmental stiction problems.

An RF MEMS capacitive switch aligns and sizes holes (such as the existing vent holes) in one of its electrodes to its insulating posts to reduce trapped charge without affecting the capacitance ratio of the switch. When displaced, the electrode contacts the posts' one or more contact surfaces around the plurality of holes so that each hole overlaps at least a central portion of the post to which the hole is aligned. By selecting the hole size such that the top electrode appears to be approximately a continuous conductive sheet at the frequency of the RF signal, the alignment of the holes to the posts reduces the amount of trapped charged without lowering the capacitance. In different embodiments, the post diameter may be smaller than the hole diameter so that the overlap is complete, in which case trapped charge is largely eliminated.

Without loss of generality, various embodiments of the invention illustrating the alignment of electrode holes with dielectric posts in a "membrane" type of RF MEMS capacitive switch will be described. One of ordinary skill in the art will understand that the alignment of electrode holes with dielectric posts may be incorporated into other types of MEMS capacitive switches without departure from the scope of the present invention.

Referring now to FIGS. 3*a*-3*d*, an embodiment of an RF MEMS capacitive switch 100 of a "membrane" type embodies aspects of the present invention. In particular, the dielectric material has been patterned to have an array of dielectric posts and one or more dielectric contact surfaces that separate a bottom electrode from a suspended top electrode in which the posts are aligned to holes in top electrode to reduce trapped charge. The drawings are diagrammatic and not to scale, in order to present the switch 100 in a manner which facilitates a clear understanding of the present invention.

Switch 100 includes a silicon semiconductor substrate 102 having on an upper side thereof an oxide layer 104. Although the substrate 102 is a made of silicon in this disclosed embodiment, it could alternatively be made of some other suitable material, such as gallium arsenide (GaAs), or a suitable alumina. Similarly, the oxide layer 104 is silicon dioxide in this disclosed embodiment, but could alternatively be some other suitable material. Two posts 106 and 108 are provided at spaced locations on the oxide layer 104, and are each made of a conductive material. In this embodiment the posts are made of gold, but they could alternatively be made of some other suitable conductive material. An electrically conductive bottom electrode 110 serves as a transmission line, and is elongated in a direction perpendicular to the plane of FIG. 3*a*. Electrode 110 is made of gold, but it could alternatively be made from some other suitable material and is approximately 200 to 400 nm thick. A dielectric layer is patterned to form an array of dielectric posts 112 on electrode 110. The top of each post 112 provides a dielectric contact surface 113. In the disclosed embodiment, the dielectric layer is made of silicon nitride, and has a thickness of approximately 100 to 300 nm. The substrate 102, oxide layer 104, conductive posts 106, 108, electrode 110 and dielectric posts 112 can be collectively referred to as a base portion of the switch 100.

Figure 3A:
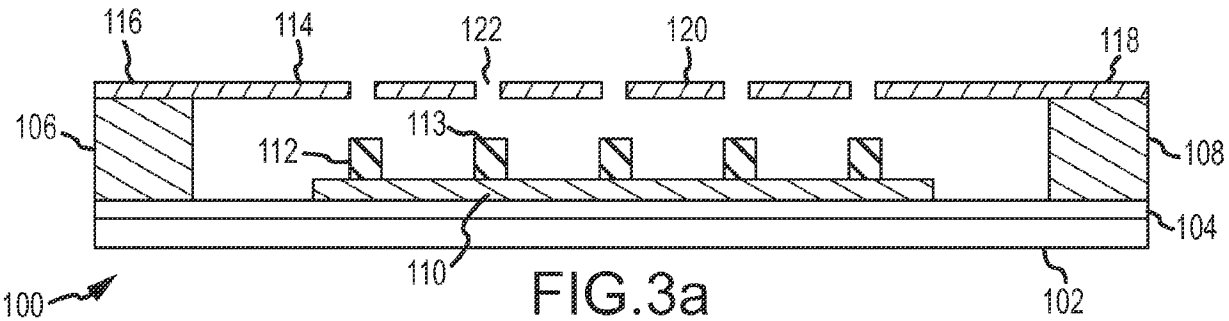
FIGS. 3*a*-3*d* are different views of an embodiment of an RF MEMS capacitive switch in which the dielectric posts are aligned to holes in the top electrode to maintain the capacitance ratio of the switch while reducing trapped charge.
Figure 3B:
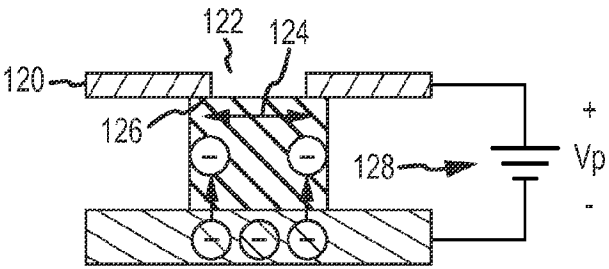

A conductive membrane 114 extends between the upper ends of the posts 106 and 108. In the disclosed embodiment, the membrane 114 is made of a known aluminum alloy, and in fact could be made of any suitable material that is commonly used to fabricate membranes in MEMS switches. The membrane 114 has ends 116 and 118, which are each fixedly supported on the top portion of a respective one of the posts 106 and 108. The membrane 114 has, between its ends 116 and 118, a central portion 120 that is disposed directly above the electrode 110 and the dielectric posts 112. Central portion 120 constitutes a top electrode. In other embodiments, the membrane may be fabricated from a non-conductive material and patterned with a conductive material to form the central portion and the top electrode. The membrane 114 is approximately planar in the view of FIG. 3*a*, but is capable of flexing so that its central portion 120 moves downwardly until it contacts the dielectric posts 112 as shown in FIG. 3*b*.

Figure 3C:
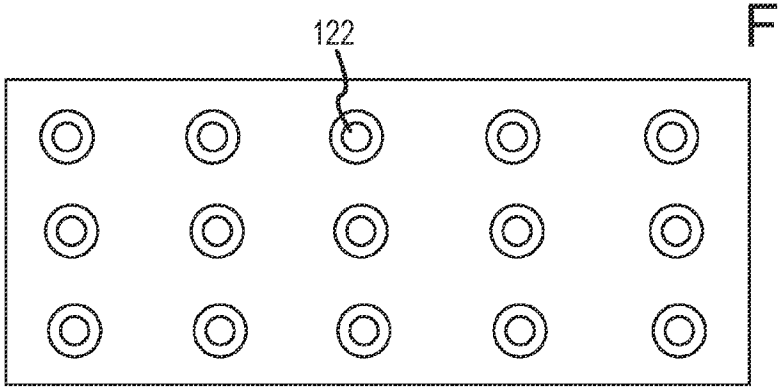
Figure 3D:
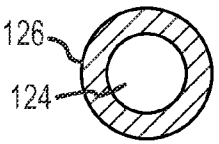

Conductive membrane 114 is fabricated with an array of holes 122 in central portion 120 that extend through the membrane and are aligned to underlying posts 112 so that each said hole overlaps at least a central portion 124 of the post to which the hole is aligned as shown in top views of FIGS. 3*c* and 3*d*. Holes 122 may suitably be the vent holes that are used to remove sacrificial material during fabrication and to reduce squeeze-film damping when the membrane is displaced. Contrary to accepted industry practice, the holes 122 are now aligned to the underlying posts 112. In this embodiment, the hole diameter is less than the post diameter so that in the actuated position central portion 120 contacts each dielectric post 112 in an annular ring 126 around the periphery of the post. Although shown as circular the holes 122 and posts 112 may take on other and different shapes. Consequently, annular ring 126 is not necessarily circular. At RF frequencies between 300 MHz and 90 GHz each hole may have a diameter between 1 um (microns) and 8 um. The slightly larger post diameters may range from 2 um to 10 um.

During operational use of the switch 100, a radio frequency (RF) signal having a frequency in the range of approximately 300 MHz to 90 GHz is caused to travel through one of the membrane 114 and the electrode 110. More specifically, the RF signal may be traveling from the post 106 through the membrane 114 to the post 108. Alternatively, the RF signal may be traveling through the electrode 110 in a direction perpendicular to the plane of the FIG. 3*a*. Holes 122 are sized so that central portion 120 appears to be approximately a continuous conductive sheet at the RF signal frequency so that the RF signal "sees" the underlying dielectric material in posts 112. Consequently, the capacitance ratio is unaffected by aligning the posts 112 to the holes 122.

Actuation of the switch 100 is carried out under control of a direct current (DC) bias voltage 128, which is applied between the membrane 114 and the electrode 110 by a control circuit of a type known in the art. This bias voltage can also be referred to as a pull-in voltage (Vp). When the bias voltage is not applied to the switch 100, the membrane 114 is in the position shown in FIG. 3*a*. As discussed above, an RF signal will be passing through one of the membrane 114 and the electrode 110. For convenience, in the discussion that follows, it will be assumed that the RF signal is passing through the electrode 110. When the membrane 114 is in the deactuated position of FIG. 3*a*, the RF signal traveling through the electrode 110 will pass through the switch 100 and continue traveling through the electrode 110, with no significant coupling of this RF signal from the electrode 110 over to the membrane 114.

In order to actuate the switch 100, a DC bias voltage (pull-in voltage Vp) is applied between the electrode 110 and the membrane 114. This bias voltage produces charges on the membrane 114 and on the electrode 110, which in turn produce an electrostatic attractive force that urges the central portion 120 of the membrane 114 toward the electrode 110. This attractive force causes the membrane 114 to flex downwardly, so that its central portion 120 moves toward the electrode 110. The membrane 114 flexes until its central portion 120 engages the top contact surfaces 113 of dielectric posts 112 in annular rings 126, as shown in FIG. 3*b*. This is the actuated position of the membrane. In this position, the capacitive coupling between the electrode 110 and the central portion 120 of the membrane 114 is approximately 100 times greater than when the membrane 114 is in the deactuated position shown in FIG. 3*a*. Consequently, the RF signal traveling through the electrode 110 will be coupled substantially in its entirety from the electrode 110 over into the membrane 114, where it will tend to have two components that travel away from the central portion 120 of the membrane in opposite directions, toward each of the posts 106 and 108. Alternatively, if the RF signal had been traveling through the membrane 114 from the post 106 to the post 108, the RF signal would have been coupled substantially in its entirety from the central portion 120 of the membrane over to the electrode 110, where it would tend to have two components that travel away from the switch 100 in respective opposite directions through the electrode 110.

Once the membrane 114 has reached the actuated position shown in FIG. 3*b*, the control circuit may optionally reduce the DC bias voltage (pull-in voltage Vp) to a standby or hold value. The standby or hold value is less than the voltage that was needed to initiate downward movement of the membrane 114 from the position shown in FIG. 3*a*, but is sufficient to maintain the membrane 110 in the actuated position of FIG. 3*b*, once the membrane has reached this actuated position.

While the membrane 114 is in the actuated position of FIG. 3*b*, the actual physical contact between the membrane 114 and the dielectric post 112, hence the electric field is limited to annular region 126. Since the operative coupling between the membrane 114 and electrode 110 involves capacitive coupling, rather than direct physical contact, as described previously with the proper sizing of holes 122 the alignment of holes 122 and dielectric posts 112 does not have a significant effect on the operation of the switch 100 and more specifically the capacitance ratio of the switch.

The electric field formed by the DC bias voltage is not present in the central portion 124 of the dielectric post 112 formed by the overlap of hole 122 with the dielectric post 112. Consequently, there is less total area of physical contact through which electric charge from the membrane 114 can pass, and this in turn reduces the amount of charge that can tunnel into and become trapped in the dielectric posts 112. This means that the rate at which trapped charge can build up in the dielectric posts 112 is substantially lower for the switch of FIGS. 3*a*-3*d* than for pre-existing switches. Assuming the same number and size of dielectric posts and the same number and size of vent holes, alignment of the holes and posts in accordance with the present invention reduces the effects of trapped charge dramatically as compared to the pre-existing switch design of FIGS. 1*a*-1*d* without sacrificing capacitance ratio contrary to accepted industry practice.

As a result, it takes much longer for the switch 100 to reach a state where the amount of trapped charge in the dielectric posts can attract the membrane 114 with a force sufficiently large to prevent the switch 100 from deactuating when the DC bias voltage (pull-in voltage Vp) is terminated. Therefore, the effective operational lifetime of the switch 100 is substantially longer than for pre-existing switches.

A secondary advantage of the aligned hole/post switch topology is that, by reducing the total area of physical contact between the membrane 114 and the dielectric posts 112, there is a reduction in Van Der Walls forces which tend to cause attraction between the membrane 114 and dielectric posts 112, and which thus resist movement of the membrane 114 away from the dielectric posts 112. This "environmental" stiction simply compounds the trapped charge stiction.

In order to deactivate the switch 100, the control circuit terminates the DC bias voltage (pull-in voltage Vp) that is being applied between the membrane 114 and the electrode 110. The inherent resilience of the flexible membrane 114 produces a relatively strong restoring force, which causes the central portion 1120 of the membrane to move upwardly away from the dielectric posts 112 and the electrode 110, until the membrane reaches the position shown in FIG. 3*a*.

Figure 4A:
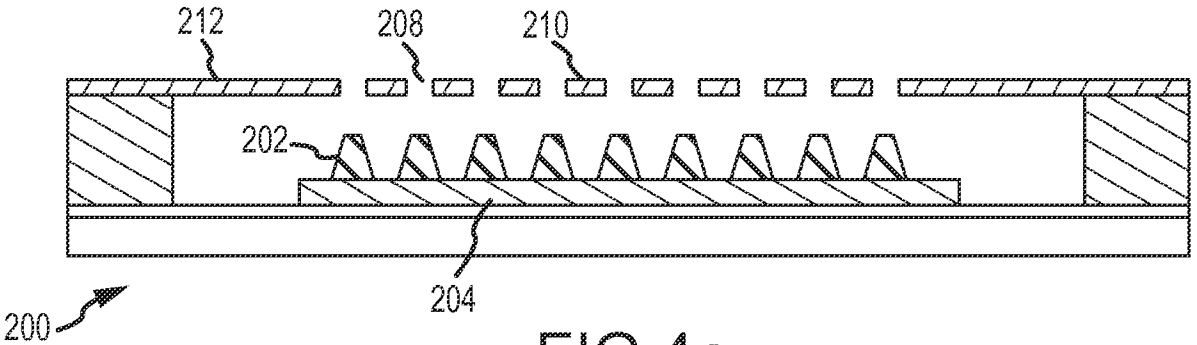
FIGS. 4*a*-4*c* are different views of another embodiment of an RF MEMS capacitive switch in which conically-shaped posts are aligned to the holes.
Figure 4B:
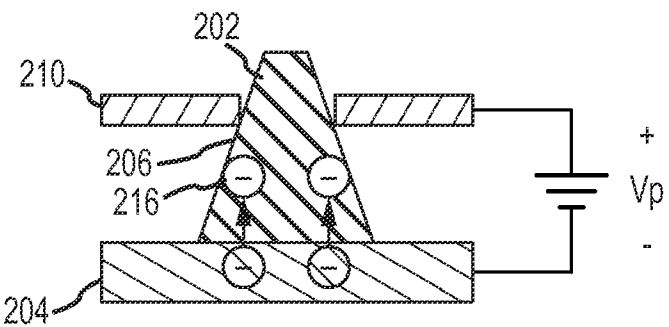
Figure 4C:
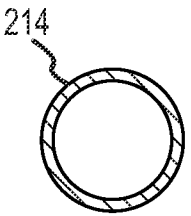

Referring now to FIGS. 4*a*-4*c*, another embodiment of an RF MEMS capacitive switch 200 of a "membrane" type embodies aspects of the present invention. In this embodiment, each post 202 is conically-shaped to taper from a base diameter on a bottom electrode 204 to smaller tip diameter. A contact surface 206 is the surface of the conically shaped post. The diameter of each aligned hole 208 in a central portion 210 of a membrane 212 is greater than the tip diameter and smaller than the base diameter. When activated, membrane 212 is displaced toward the bottom electrode 204 so that the tips of dielectric posts 202 extend up and through their respective aligned holes 208 in the central portion 210 of the membrane 212. The membrane is displaced until the inner diameter of hole 208 equals the outer diameter of conically-shaped post 202 at which point the central portion 210 of the membrane 212 only contacts the conically shaped post 202 in an annular ring 214 around the post 202. In this topology, annular ring 214 is very thin, hence the amount of trapped charge 216 is small.

In different embodiments, the posts support contact surfaces that provide the surface area to contact the membrane and the holes to prevent the membrane from contacting the bottom electrode. The posts themselves may be fabricated with a diameter that is smaller than the aligned hole diameter. This "undercutting" of the post causes the hole to overlap the entire post. As a result, the electric field lines produced by the DC bias voltage (ignoring fringing fields) do not overlap the post, in which case trapped charge is largely eliminated. As will be described below, this may be achieved by undercutting the posts shown in FIGS. 3*a*-3*d* to create a contact pad that interfaces with the hole and a post whose diameter is less than the hole. Alternately, multiple undercut posts (aligned to the holes) may support an elevated dielectric layer.

Figure 5A:
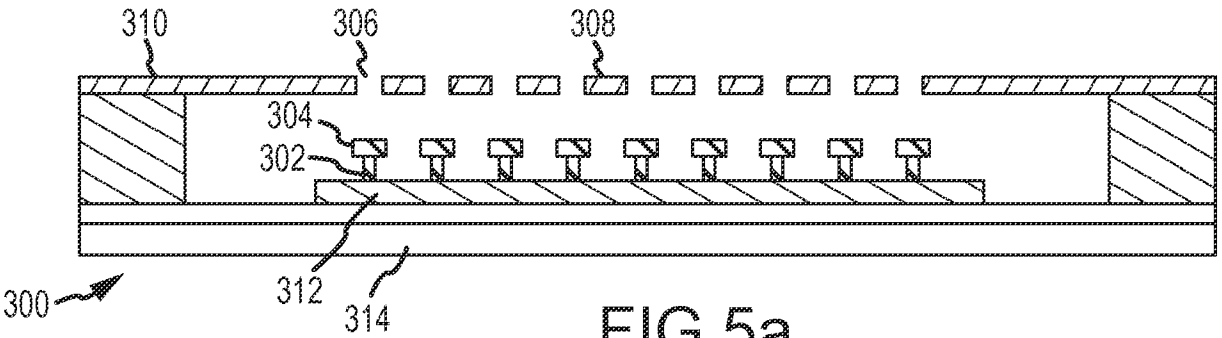
FIGS. 5*a*-5*c* are different views of an RF MEMS capacitive switch in which the post supports a contact pad and the post is undercut to have a smaller diameter than the aligned hole to substantially eliminate trapped charge.
Figure 5B:
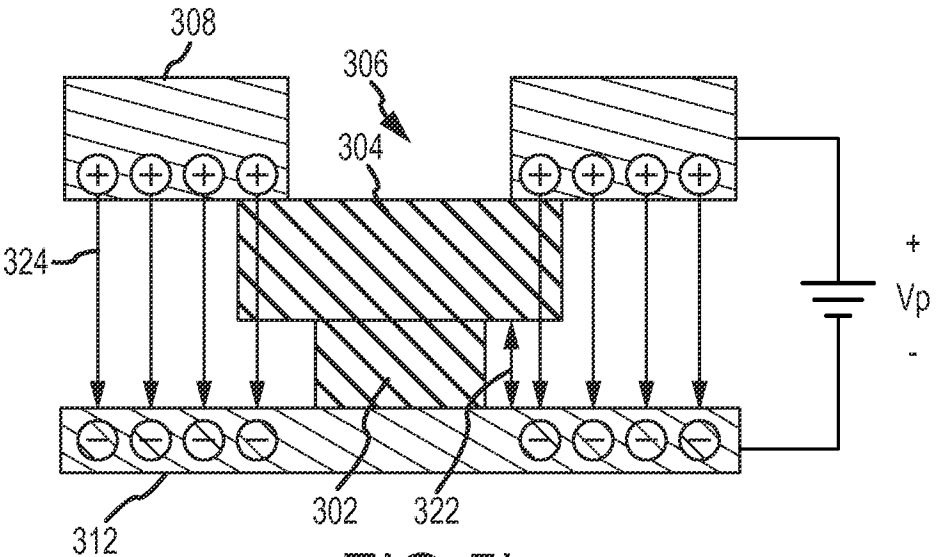
Figure 5C:
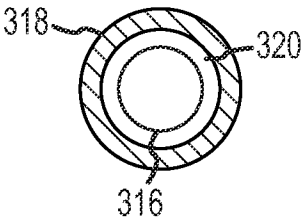

Referring now to FIGS. 5*a*-5*c*, another embodiment of an RF MEMS capacitive switch 300 of a "membrane" type embodies aspects of the present invention. In this embodiment, posts 302 (similar to dielectric posts 112 in the embodiment shown in FIGS. 3*a*-3*d*) are undercut to define contact pads 304. The diameter of contact pad 304 is greater than the diameter of its aligned hole 306 to provide the contact surface to prevent a central portion 308 of a membrane 310 from contacting a bottom electrode 312 on a substrate 314. The diameter 316 of post 302 is less than the diameter 318 of its contact pad 304, and preferably less than the diameter 320 of its aligned hole 306 so that each said hole overlaps the entire post as shown in FIG. 5*c*. Contact pad 304 forms an air gap 322 around post 302 between the contact pad 304 and the bottom electrode 312. When activated as shown in FIG. 5*b*, the displaced central portion 308 only contacts the contact pad 304 over the air gap 322 and does not overlap the post 302. As a result, the electric field lines 324 produced by the DC bias voltage Vp (ignoring fringing fields) do not overlap the post 302, in which case trapped charge is largely eliminated.

Figure 6A:
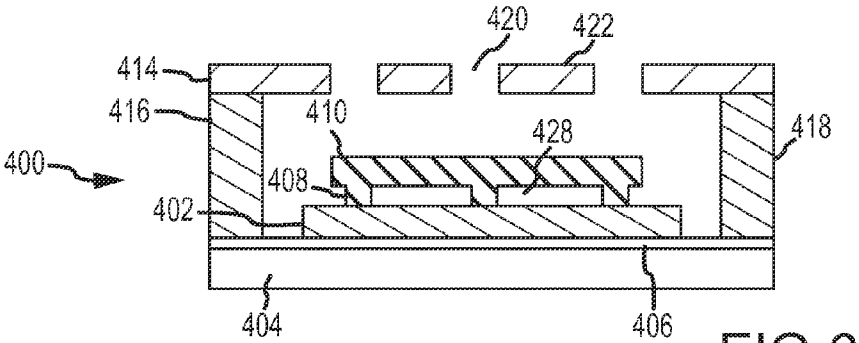
FIGS. 6*a* and 6*b* are different views of an RF MEMS capacitive switch in which multiple posts support a dielectric layer, each post being under cut to have a smaller diameter than its aligned hole to substantially eliminate trapped charge.
Figure 6B:
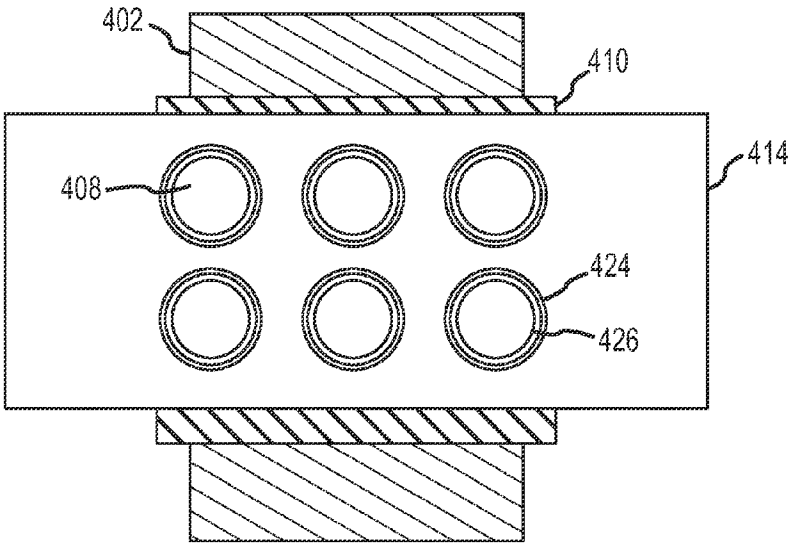

Referring now to FIGS. 6*a*-6*b*, another embodiment of an RF MEMS capacitive switch 400 of a "membrane" type embodies aspects of the present invention. In this embodiment, a conductive bottom electrode 402 is patterned on a substrate 404 and oxide layer 406. A plurality of dielectric posts 408 supports a dielectric layer 410 above bottom electrode 402. A conductive membrane 414 is supported on conductive posts 416 and 418 above the dielectric layer 410. A plurality of holes 420 is formed in a central portion 422 of membrane 414. Each hole is aligned to one of the dielectric posts 408 so that each said hole overlaps at least a central portion of the post. The diameter 424 of the hole 420 is preferably greater than the diameter 426 of the post 408 so that the hole overlaps the entire post (as shown in FIG. 6*b* with dielectric layer 410 shown in transparency). Dielectric layer 410 forms an air gap 428 around each post 408. When activated, the displaced central portion 422 of membrane 414 contacts the dielectric layer 410 over the air gap 428 and does not overlap the posts 408. As a result, the electric field lines produced by the DC bias voltage Vp (ignoring fringing fields) do not overlap the post 408, in which case trapped charge is largely eliminated, as similarly explained with respect to FIG. 5*b*.

Figure 7A:
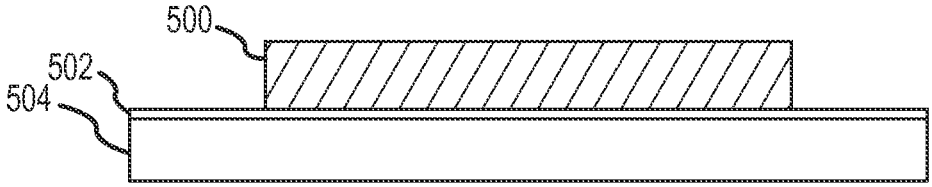
FIGS. 7*a*-7*g* are section views of an embodiment of a process for fabricating the RF MEMS capacitive switch shown in FIGS. 5*a* and 5*b*.
Figure 7B:
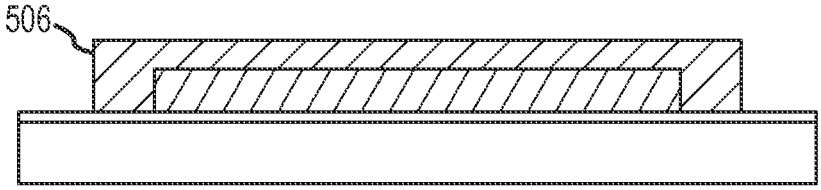
Figure 7C:
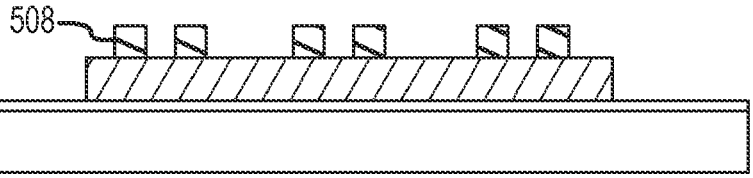
Figure 7D:
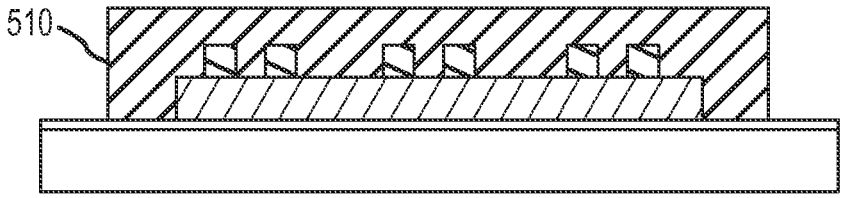
Figure 7E:
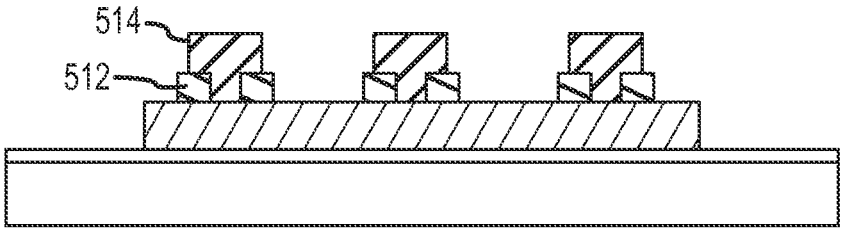
Figure 7F:
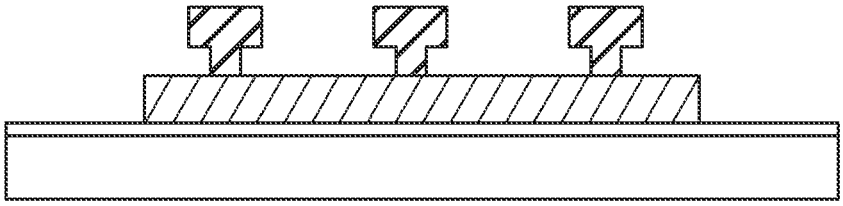
Figure 7G:
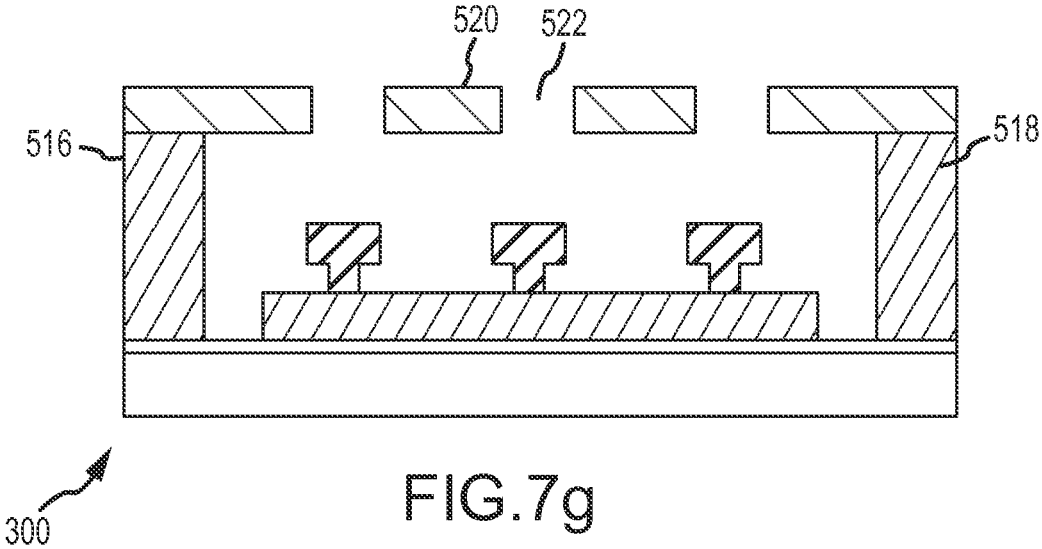

Referring now to FIGS. 7*a*-7*g*, an embodiment of a method of fabricating the RF MEMS capacitive switch 300 shown in FIGS. 5*a*-5*c* embodies aspects of the present invention. As shown in FIG. 7*a*, a conductive bottom electrode 500 is deposited and patterned on a silicon dioxide layer 502 on a silicon substrate 504. A sacrificial layer 506 such as silicon dioxide is then deposited over bottom electrode 500 (FIG. 7*b*). Sacrificial layer 506 is masked and etched to provide spacers 508 that define the undercut area for the posts (FIG. 7*c*). A dielectric layer 510 such as Silicon Nitride (SiN) is deposited over the substrate (FIG. 7*d*). Dielectric layer 510 is masked and etched to form dielectric posts 512 that support dielectric contact pads 514 of greater diameter (FIG. 7*e*). The sacrificial layer is removed (FIG. 7*f*). Lastly, the substrate is processed to add the conductive posts 516 and 518 that support conductive membrane 520. The membrane 520 is masked and etched to define holes 522 that are aligned to the posts 512 and contact pads 514 (FIG. 7*g*). Alignment tolerances of approximately 1 micron can be achieved with current fabrication processes. This is but one embodiment for fabrication an RF MEMS capacitive switch that embodies the aligned hole/post aspect and undercut aspect of the present invention. Other fabrication processes and materials may be used to fabricate such MEMS capacitive switches without departing from the scope of the invention.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A micro-electro-mechanical system (MEMS) switch comprising:

a first electrode having a top surface;

a second electrode configured to be displaced toward the first electrode in response to the application of a voltage differential between the first and second electrodes;

a patterned dielectric material on the top surface of the first electrode, said patterned dielectric material having a plurality of posts on the top surface of the first electrode between the first and second electrodes that support one or more dielectric contact surfaces that prevent the second electrode from contacting the first electrode; and a plurality of holes in the second electrode, each said post aligned to a different one of the plurality of holes, wherein the displaced second electrode contacts the one or more dielectric contact surfaces around the plurality of holes so that each said hole overlaps at least a central portion of the post to which the hole is aligned.

2. The MEMS switch of claim 1, wherein the diameter of each said post is smaller than the diameter of the hole to which the post is aligned so that each said hole overlaps the entire post, said patterned dielectric material forming an air gap around each said post between the contact surface and the first electrode, wherein the displaced second electrode only contacts the contact surface over the air gap and does not overlap the post.

3. The MEMS switch of claim 2, wherein each said contact surface comprises a dielectric contact pad supported by one said post, the diameter of each said contact pad being greater than the diameter of the hole and the post, wherein the second electrode only contacts each said contact pad in an annular ring around the hole.

4. The MEMS switch of claim 2, wherein the one or more contact surfaces comprise a dielectric layer supported above the first electrode by the plurality of posts.

5. The a MEMS switch of claim 1, wherein each said contact surface is a top surface of one the posts, the diameter of each said post being greater than the diameter of the hole so that the second electrode only contacts the top surface of each said post in an annular ring around the hole.

6. The MEMS switch of claim 1, wherein each said post is conically-shaped to taper from a base diameter on the first electrode to a smaller tip diameter and said contact surface is the surface of the conically-shaped post, wherein the diameter of each said hole in the second electrode is greater than the tip diameter and smaller than the base diameter so that the hole in the displaced second electrode only contacts the conically shaped post in an annular ring around the post where the post diameter equals the hole diameter.

7. The MEMS switch of claim 1, wherein the displaced second electrode only contacts the contact surfaces in a plurality of annular rings around the posts.

8. The MEMS switch of claim 1, wherein the diameter of the holes is such that at RF frequencies between 300 MHz to 90 GHz the second electrode appears as approximately a continuous conductive sheet.

9. The MEMS switch of claim 8, wherein each hole has a diameter between 1 um and 8 um and each post has a diameter between 2 um and 10 um.

10. The MEMS switch of claim 8, wherein the overlap of each said hole with at least the central portion of the post to which the hole is aligned reduces trapped charge in the post without reducing a capacitance of the MEMS switch between the first and second electrodes.

11. A micro-electro-mechanical system (MEMS) switch comprising:

a first electrode;

a second electrode configured to be displaced toward the first electrode in response to the application of a voltage differential between the first and second electrode;

a patterned dielectric material between said first and second electrodes, said patterned dielectric material having a plurality of posts that prevent the second electrode from contacting the first electrode; and a plurality of holes in the second electrode, each said hole aligned to one said post, each said hole having a diameter that is less than the diameter of the post to which the hole is aligned so that the displaced second electrode only contacts each said post in an annular ring and said hole overlaps at least a central portion of the post to which the hole is aligned.

12. The MEMS switch of claim 11, wherein each said post is conically-shaped to taper from a base diameter on the first electrode to a smaller tip diameter, wherein the diameter of each said hole in the second electrode is greater than the tip diameter and smaller than the base diameter so that the hole in the displaced second electrode only contacts the conically shaped post in an annular ring around the post where the post diameter equals the hole diameter.

13. The MEMS switch of claim 11, wherein each said post comprises a dielectric contact pad supported by the post, the diameter of each said contact pad being greater than the diameter of the hole that is greater than the diameter of the post, said contact pad forming an air gap around each said post between the contact pad and the first electrode, wherein the displaced second electrode only contacts each said contact pad in an annular ring around the hole over the air gap and does not overlap the post.

14. The MEMS switch of claim 10, wherein the diameter of the holes is between 1 um and 8 um s such that at RF frequencies between 300 MHz to 90 GHz the second electrode appears as approximately a continuous conductive sheet.

15. A micro-electro-mechanical system (MEMS) switch comprising:

a first electrode;

a second electrode configured to be displaced toward the first electrode in response to the application of a voltage differential between the first and second electrodes;

a patterned dielectric material between said first and second electrodes, said patterned dielectric material having a plurality of posts that support one or more dielectric contact surfaces that prevent the second electrode from contacting the first electrode; and a plurality of holes in the second electrode aligned to the plurality of posts, respectively, said diameters of the holes being greater than the diameters of the posts so that the patterned dielectric material forms air gaps around the posts between the one or more contact surfaces and the first electrode;

wherein the displaced second electrode only contacts the one or more contact surfaces around the plurality of holes over the air gaps and does not overlap the posts.

16. The MEMS switch of claim 15, wherein each said contact surface comprises a dielectric contact pad supported by one said post, the diameter of each said contact pad being greater than the diameters of the hole and the post, wherein the second electrode only contacts each said contact pad in an annular ring around the hole over the air gap and does not overlap the post.

17. The MEMS switch of claim 15, wherein the one or more said contact surfaces comprises a dielectric layer supported above the first electrode by the plurality of posts.

18. The MEMS switch of claim 15, wherein the diameter of the holes is between 1 um and 8 um is such that at RF frequencies between 300 MHz to 90 GHz the second electrode appears as approximately a continuous conductive sheet.

19. A micro-electro-mechanical system (MEMS) switch comprising:

a first electrode;

a second electrode configured to be displaced toward the first electrode in response to the application of a voltage differential between the first and second electrodes;

a patterned dielectric material between said first and second electrodes, said patterned dielectric material a plurality of posts that support a respective plurality of contact pads, each said contact pad having a first diameter that is greater than a second diameter of the post to form an air gap around the post between the contact pad and the first electrode, wherein the contact pads prevent the second electrode from contacting the first electrode; and a plurality of holes in the second electrode, each said hole aligned to one said contact pad, each said hole having a third diameter that is less than the contact pad's first diameter and greater than the post's second diameter so that the displaced second electrode only contacts the patterned dielectric material in annular rings on the contact pads over the air gaps that do not overlap the posts.

20. The MEMS switch of claim 19, wherein the diameter of the holes is between 1 um and 8 um is such that at RF frequencies between 300 MHz to 90 GHz the second electrode appears as approximately a continuous conductive sheet.

* * * * *